US006073424A

United States Patent [19]

Kraft et al.

[11] Patent Number: 6,073,424

[45] Date of Patent: Jun. 13, 2000

[54] APPARATUS FOR TREATING FLEXIBLE BAGS

[75] Inventors: Eberhard Kraft, Neckarbischofsheim, Germany; Hans-Peter Wild, Zug, Switzerland

[73] Assignee: INDAG Gesellschaft fur Industriebedarf m.b.H, Eppelheim/Heidelberg, Germany

[21] Appl. No.: 09/162,048

[22] Filed: Sep. 28, 1998

[30] Foreign Application Priority Data

Oct. 10, 1997 [DE] Germany ..... 197 44 899

[51] Int. Cl.[7] ..... B65B 43/26; B65B 43/28

[52] U.S. Cl. ..... 53/570; 53/562; 53/384.1

[58] Field of Search ..... 53/459, 562, 570, 53/384.1, 202

[56] References Cited

U.S. PATENT DOCUMENTS

| | | | |
|---|---|---|---|
| 4,108,300 | 8/1978 | Hayase et al. | 53/570 |
| 4,263,768 | 4/1981 | Russell et al. | 53/384.1 |
| 4,674,266 | 6/1987 | Araki | 53/202 |
| 5,058,364 | 10/1991 | Seiden et al. | 53/570 |
| 5,673,541 | 10/1997 | Arzuman | 53/570 |

FOREIGN PATENT DOCUMENTS

| | | |
|---|---|---|
| 0726202A1 | 8/1996 | European Pat. Off. . |
| 0778206A2 | 6/1997 | European Pat. Off. . |
| 2653995 | 6/1977 | Germany . |
| 60-2421 | of 0000 | Japan . |
| 64-84827 | of 0000 | Japan . |

*Primary Examiner*—John Sipos
*Attorney, Agent, or Firm*—Tilton, Fallon, Lungmus & Chestnut

[57] ABSTRACT

Method of treating flexible bags, in particular for opening, filling and closing in successive treatment stations, and to a filling machine for carrying out said method. In the method the bags are transported in suspended fashion in holding devices of which at least two are provided per bag, and the bags are changed in shape by a relative movement of the respective holding devices relative to one another. In the filling machine there are receiving elements for the bags of an opening station, a filling station, and a closing station which has two holding devices per receiving element for jointly holding a bag in the upper portion of said bag, the holding devices of one receiving element being movable relative to each other.

19 Claims, 5 Drawing Sheets

APPARATUS FOR TREATING FLEXIBLE BAGS

FIELD OF THE INVENTION

The present invention relates to a method for treating flexible bags, in particular for opening, filling and closing, flexible bags, and to a filling machine for carrying out the method.

BACKGROUND OF THE INVENTION

To subject flexible, upwardly unclosed bags to the necessary treatment steps, such as shaping the filling opening, filling the bags with filling material and subsequent closing, so-called in-line indexing machines are used. The bags are guided in receiving elements past the treatment stations, with a plurality of bags being simultaneously treated in different treatment stations. The weight of the bags is supported in known machines on the bottom surface of the receiving containers, i.e., the bags are transported in an upright position. Stationary means or mechanical means which are arranged on the receiving containers are used for opening a bag and for closing, sealing or welding the bag after it has been filled. To carry out these functions in a safe and reliable manner, known machines have a complicated structure. Furthermore, it is very troublesome to handle the necessary mechanical elements and to remove the bags from the outside from the receiving containers. Since the weight of the bags is supported from below, the bag walls must have a certain stiffness and thus a specific material thickness which must be the higher the greater the bags are.

SUMMARY OF THE INVENTION

It is the object of the present invention to provide a method and an apparatus for treating flexible bags which permit a simple and safe handling of the bags and can also be employed in the case of bags that are not very stiff.

In the method of the invention, the bags are transported in holding devices in suspended fashion through the individual treatment stations, with at least two holding devices being provided each bag and the bags being changed in shape by a relative movement of the respective holding devices relative to one another. Changed in shape means a change in the exterior shape of the bags, as follows when the lateral walls must be moved apart for blowing in compressed air or for filling purposes.

An apparatus for performing the method is characterized by the features that each of the receiving elements comprises at least two holding devices for holding a bag in suspended fashion in the upper portion of the bag, and that the two holding devices are arranged to be movable relative to one another.

Due to the fact that the bags are transported in suspended fashion, they are transported through the individual stations independently of the wall thickness of the bags in an always stable and reliable manner. Since the two holding devices which hold a respective bag are movable relative to one another, it is possible to initiate an opening process on the bags by moving the two holding devices towards one another. The bag can again be tensed and thus closed with respect to its two side walls by moving the two holding devices apart. Further members are not required for the opening and closing operations of the bags.

The use of two holding devices per bag is particularly advantageous, the holding device s holding the bag in the lateral portions near the upper edge of the bag.

The two holding devices are advantageously moved towards each other for opening the bag and are moved apart for closing or tensing the upper edge of the bag. It is possible through such a procedure to carry out the various treatment steps without the type of fixation having to be changed for the bag.

The bags are held in a simple manner in the holding devices by being clamped in place. To this end, clamp elements can be provided in an advantageous development of the apparatus.

In a simple development th e inventive filling machine comprises clamp elements each provided with a clamp block and a clamp jaw which is movable relative thereto.

In a particularly advantageous embodiment the inventive filling machine comprises a first and a second elongated carrier, the carriers extending in parallel with each other and being movable relative to one another, and the respectively first holding device of a receiving element being secured to the first carrier and the respectively second holding device to the second carrier. A carrier can here be stationary with respect to the receiving elements and the other carrier can be movable with respect to the receiving elements, or both carriers may be displaceable with respect to the receiving elements. It is possible with the help of such carriers to change the distance between the holding devices of a receiving element in a simple manner for achieving the desired change in shape of the sheet bag.

In a simple development, one or both movable carriers are provided with a respective guide roll which during movement of the receiving elements along the treatment stations of the filling machine runs along or in a guide link so that the one or both movable carriers are displaced. A guiding operation in a guide link with the help of guide rolls represents a simple possibility of moving the carriers relative to one another.

For opening the individual clamp elements, the respective clamp jaw may have formed thereon a pressing means upon the actuation of which the clamp jaw is removed from the respective clamp block. Advantageously, such a pressing means comprises an actuator with a spring, the actuating movement being performed against the force of the spring. The spring guarantees that without operation of the actuator the clamp jaw remains in the closed state and the bag thus remains clamped in place.

In a simple development the actuator is passed through the clamp block of the respective clamp element and is firmly connected to the clamp jaw.

A particularly advantageous development comprises first and second release means which during movement of the receiving elements along those stations of the filling machine on which the bags are received or discharged interact with stationary release elements in such a manner that a movement of the first and second release means effects a movement of the actuator of the pressing means against the force of the respective spring. Such release means having corresponding release elements as a counter member provide a reliable and simple mechanical mechanism for opening the holding devices so as to receive or discharge bags.

A construction in which the release means comprise rods which are in parallel with the first and second carriers is especially simple.

It is also advantageous when the distance between two holding devices of a receiving element in the longitudinal direction of the carrier is variably adjustable in response to the width of a bag. For instance, the filling machine can be used in a simple manner for different bag sizes. A particularly economic situation arises when a plurality of receiving elements are each arranged in a row in a direction perpendicular to the movement of direction, so that they pass through the treatment stations at the same time and in synchronism. In a simple development, a first carrier and a second carrier respectively belong to one row. It can thereby be ensured in an easy and reliable manner that the receiving elements of one whole row are manipulated at the same time by moving a carrier.

BRIEF DESCRIPTION OF THE DRAWINGS

The present invention shall now be explained with reference to a preferred embodiment which is shown in the drawings, in which.

DETAILED DESCRIPTION OF THE PREFERRED EMBODIMENT

Figure 1:
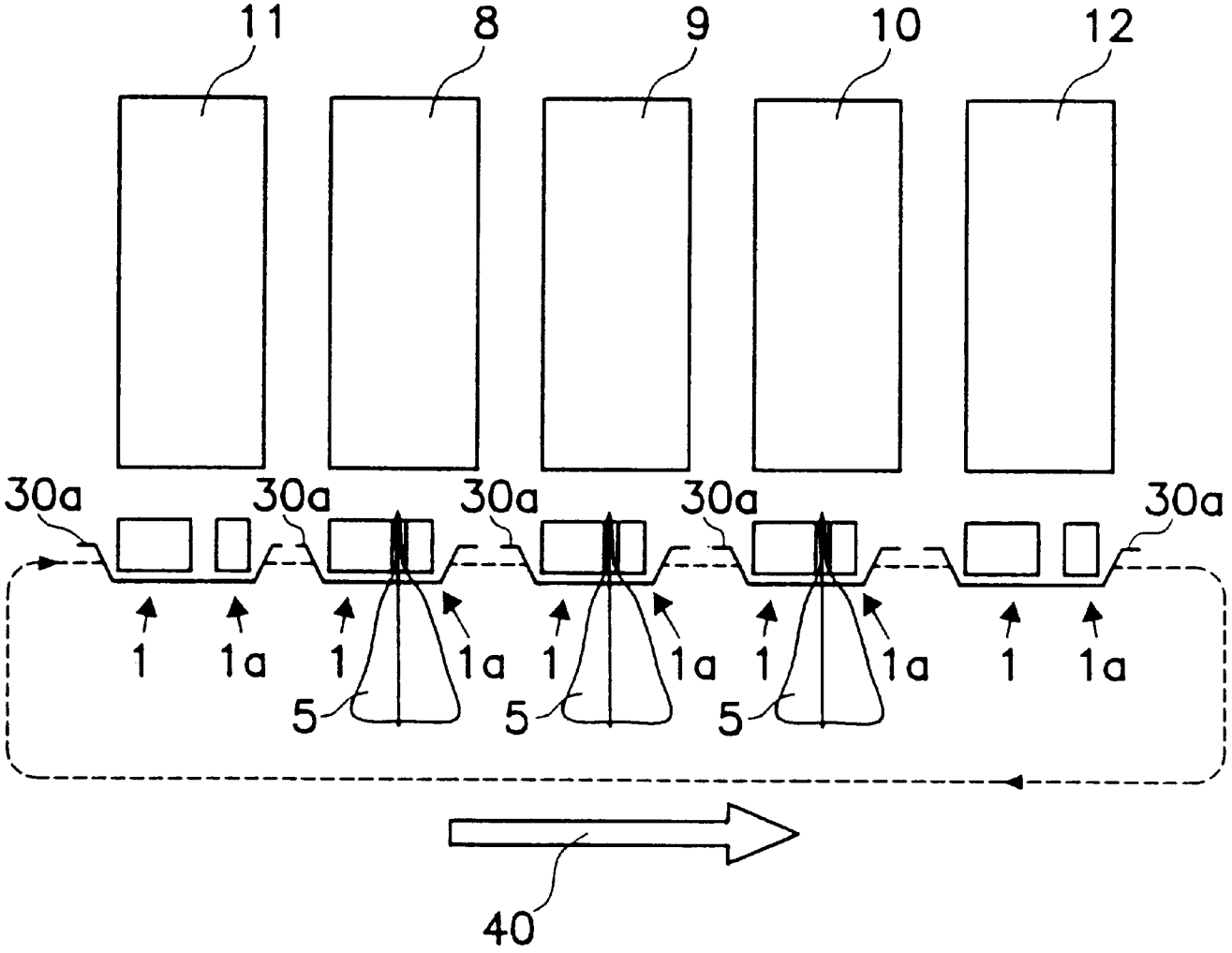
FIG. 1 is a lateral view showing a strongly schematized bag filling machine for explaining the basic structure.

FIG. 1 is a sectional view showing a filling machine in which sheet bags 5 are filled. Such sheet bags consist, for instance, of a thin coated aluminum foil and have lateral surfaces the upper edges of which can be heat-sealed for closing the bags. Downwardly, the bags are closed by a standing base which bulges outwards when being filled so that the bags are enlarged and offer room for liquids, such as beverages. At the same time, the folded bottom member of the bag is a standing surface.

In FIG. 1, reference numeral 8 designates an opening station in which the sheet bags 5 are opened in a manner to be still explained in more detail. Reference numeral 9 designates a filling station and reference numeral 10 a closing station. Constructional details of stations 8, 9, 10, e.g. filling nozzles and sealing systems, which are here of no interest, are not shown for the sake of clarity. The sheet bags 5 are held in suspended fashion by holding devices in the form of pairs of clamps 1, 3, which are connected to carrier rails 30*a* in a manner to be explained later. A plurality of pairs of clamps 1, 3 are perpendicular to the direction of transportation, which is outlined by arrow 40, they are arranged side by side and intermittently pass through the corresponding treatment steps at the same time. In the lateral view of FIG. 1, the respectively first bag of a respective row can be seen together with the first clamp 1 with the clamp jaw 1*a* of the pairs of clamps holding the bag. The distance between the individual sheet bags 5 in the direction of motion preferably corresponds to the distance between the treatment stations. The carrier rails 30*a* which have the pairs of clamps arranged thereon are guided in endless fashion by means of endless conveyors past the treatment stations. The path of rotation is schematically shown in FIG. 1 by a broken line.

Reference numeral 11 designates a transfer station in which empty sheet bags are supplied from a magazine (not shown) between the clamps 1, 3. Reference numeral 12 designates a discharge station in which the filled sheet bags are discharged from clamps 1, 3.

Figure 2:
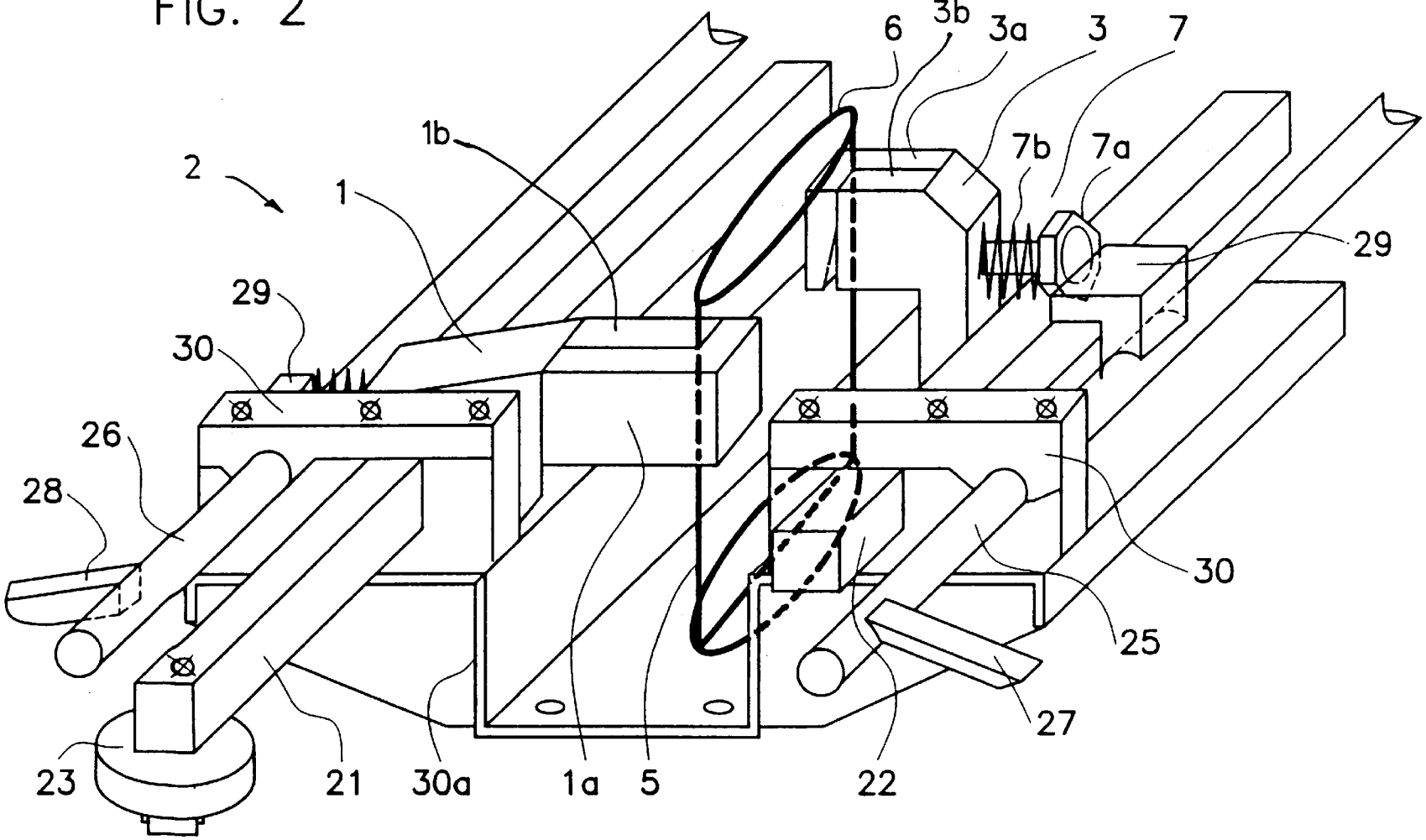
FIG. 2 is a perspective view showing a receiving element.

FIG. 2 shows a receiving element which comprises a pair of clamps 1 and 3 which serve as holding devices for the bag 5. The devices laterally engage the bag 5 in the area of the upper edge 6. The clamps 1, 3 comprise clamp jaws 1*a*, 3*a*. Clamp 1 is secured to a first carrier 21 while clamp 3 is secured to a second carrier 22. The carriers 21, 22 are movably supported relative to one another in the longitudinal direction. Each of the clamps 1, 3 comprise a plunger 7 which is equipped with a press surface 7*a* and a spring 7*b*. The plunger 7 is connected to the clamp jaw 1*a*, 3*a* through the respective clamp block. The spring 7*b* holds the respective clamps 1, 3 in the closed state. A respective rod 25, 26 is positioned in parallel with the respective carriers 21, 22, with pressing means 29 being provided on said rod 25, 26. These pressing means 29 are arranged such such they can press against the press surface 7*a* of the plunger 7. The rods 25, 26 are rotatably supported about their longitudinal axis and have release means 27 which upon a corresponding operation cause a rotation of the respective rod. Guide rolls 23 which engage into guide links (not shown in FIG. 2) are provided on the carriers 21, 22 at respectively opposite ends. The rods 25, 26 and the carriers 21, 22 are held along their length by at least two holding means 30 on the carrier rail 30*a*, of which the respectively first one is shown.

The receiving element which is shown and described in FIG. 2 is the first one of a row of receiving elements which follow said first receiving element in a direction transverse to the direction of transportation, the carriers 21, 22 and the rods 25, 26 being jointly provided for all receiving portions of one row.

Figure 3B:
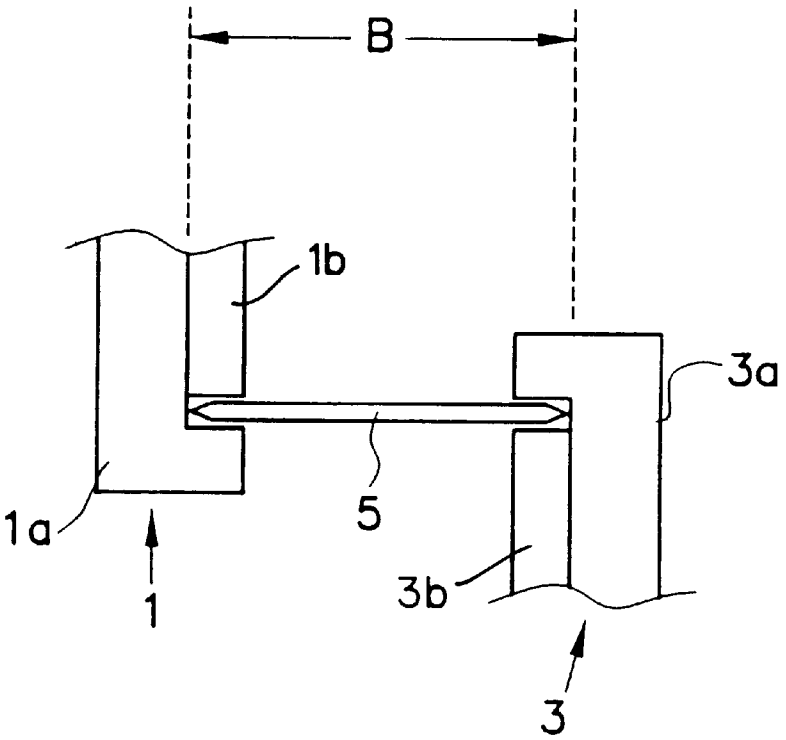
FIGS. 3*a* and 3*b* are schematic top view showing a section of a receiving element with an opened bag (FIG. 3*a*) and a closed bag (FIG. 3*b*), respectively.
Figure 3A:
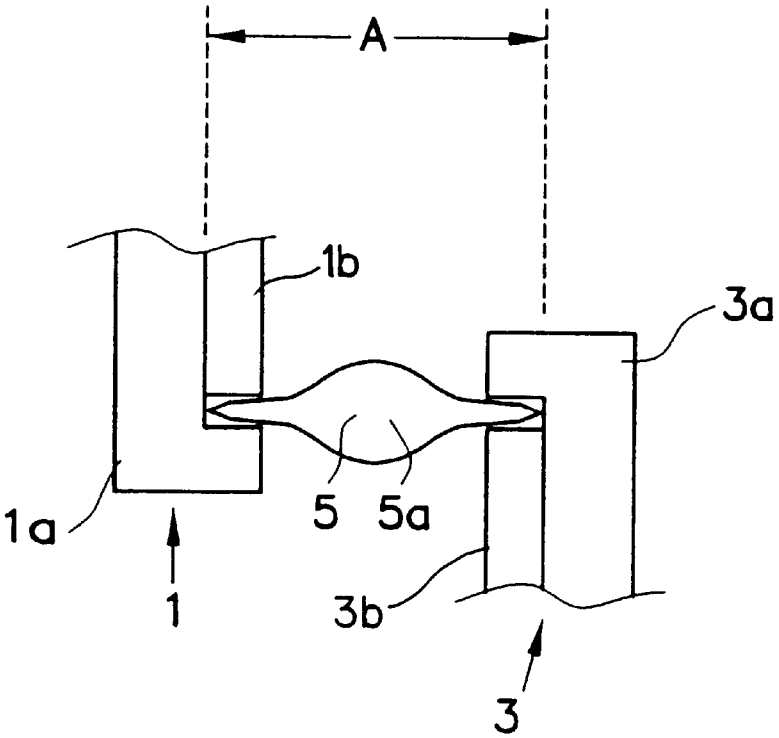

FIGS. 3*a* and 3*b* are top views on a sheet bag located in two different positions together with the clamps 1, 3. FIG. 3*a* shows the sheet bag in its opened state with opening 5*a*. Its width in this state is designated by A. FIG. 3*b* shows the bag in its closed state with a tensed upper edge. The width of bag 5 in this state is designated by B.

Figure 4:
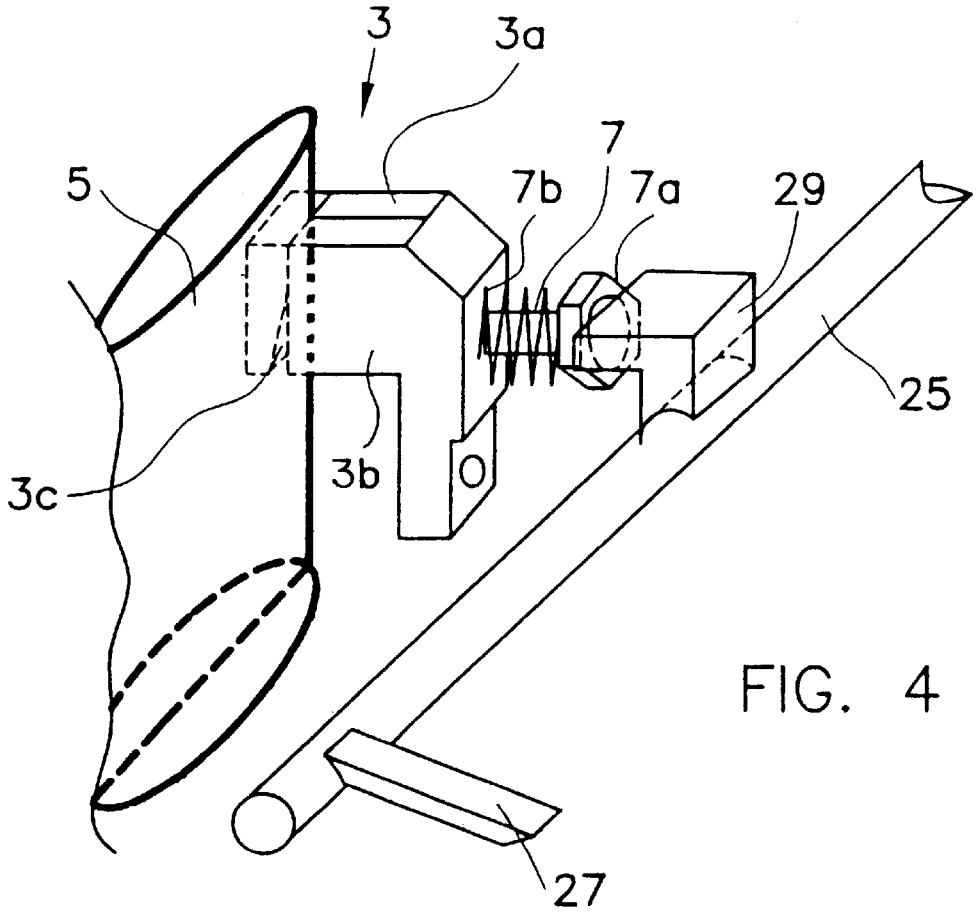
FIG. 4 shows a holding device in the closed state.

FIG. 4 shows an individual clamp 3 of a receiving element in the closed state. The clamp jaw 3*a* has an L-shaped cross-section and is movable relative to the clamp block 3*b*. The plunger 7 which is biased by spring 7*b* is guided through the clamp block. The sheet bag 5 is clamped in slot 3*c*. The pressing means 29 is connected to the rod 25.

Figure 5:
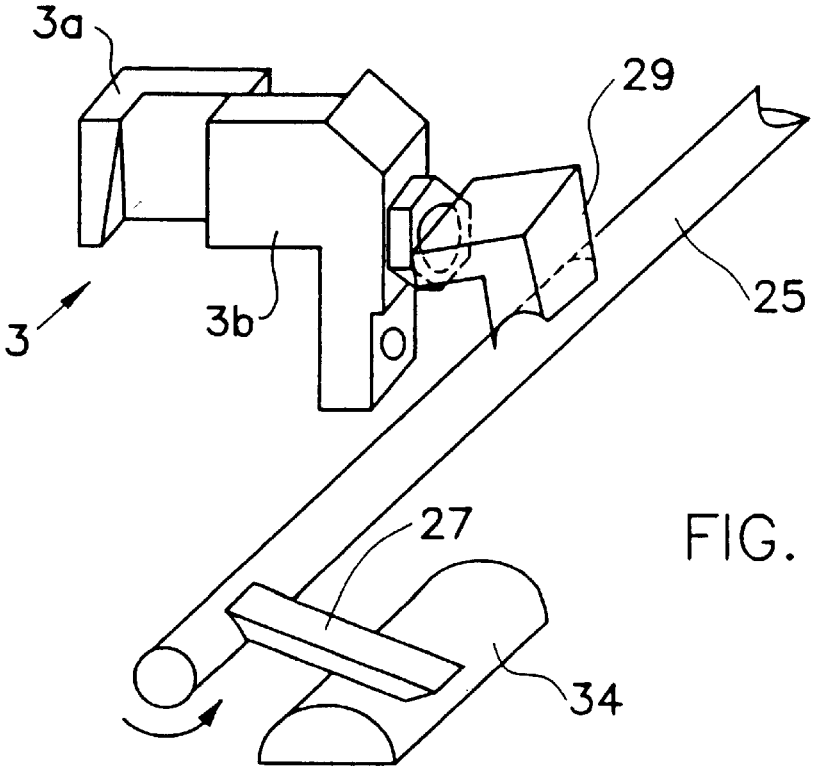
FIG. 5 shows a holding device in the opened state.

FIG. 5 shows the clamp 3 of FIG. 4 in the opened state. The spring 7 is compressed via the plunger 7 by the pressing means 29. The release means 27 interacts with a release element 34 to rotate the rod 25 about its axis.

Figure 6:
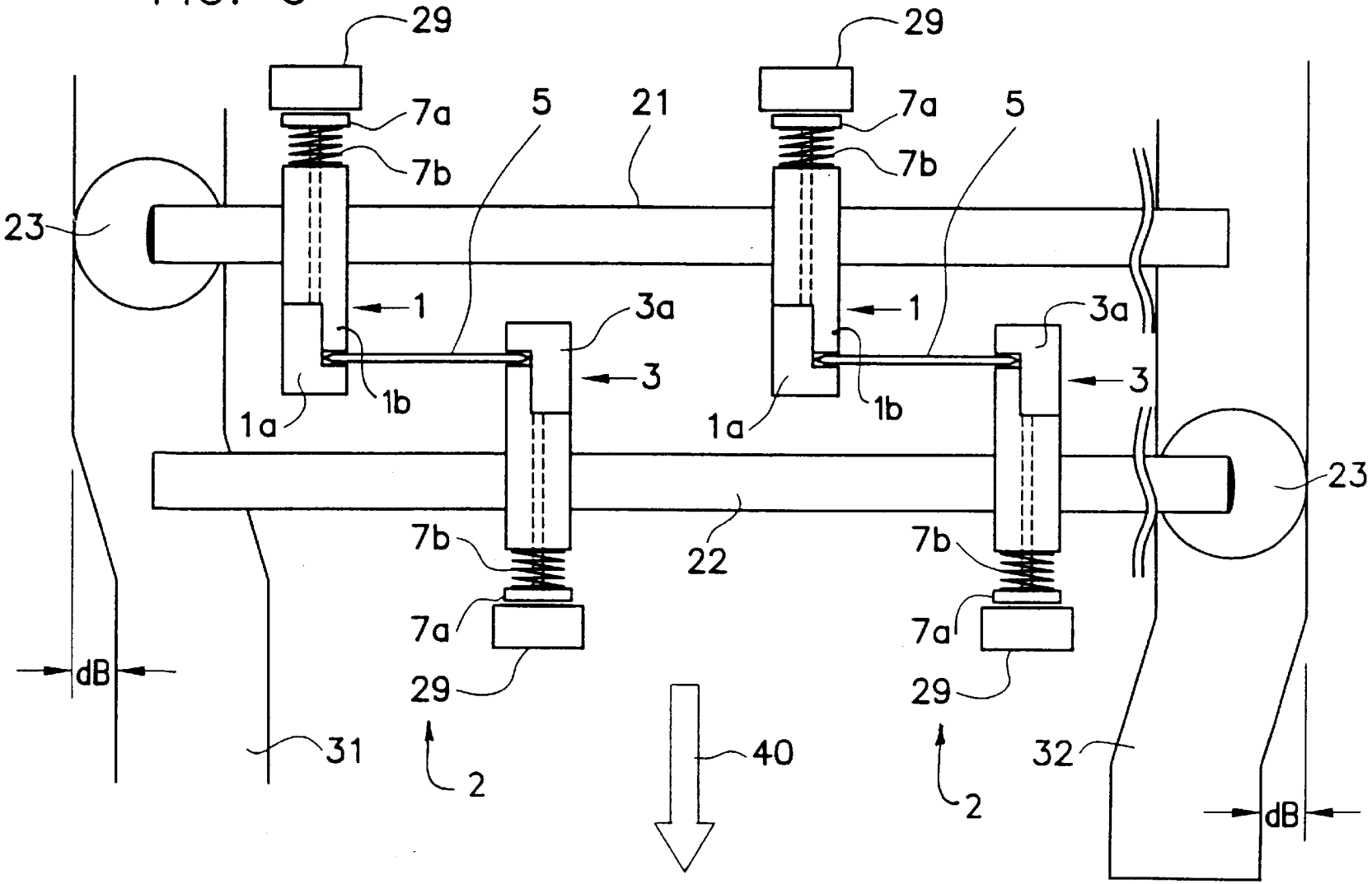
FIG. 6 is a top view showing two associated carriers with a plurality of sheet bags.

FIG. 6 is a top view schematically illustrating a row of receiving elements with sheet bags, as are guided in parallel past the various treatment stations 8, 9, 10 in the direction of arrow 40. The guide rolls 23 run in guide links 31, 32. In the illustrated embodiment the guide links 31, 32 vary their distance by the amount dB upon movement in the direction of arrow 40. There are shown two receiving elements 2 of one row. However, any other desired number is also possible.

The operation of an inventive filling machine for carrying out the method of the invention shall now be described.

The transfer station 11 comprises a magazine (not shown in more detail) for empty sheet bags and a transfer mechanism, e.g. a mechanism, which uses suction means and moves the empty sheet bags between clamps 1, 3. During movement of the carrier rail 30*a* underneath the transfer station 11 the release levers 27, 28 of the release means 25, 26 are running on release elements 34, as shown in FIG. 5. The rods 25, 26 are thereby rotated about their longitudinal axis and the respective pressing means 29 presses the respective plunger 7 against the force of spring 7*b*. The clamp jaw 3*a* which is connected to the plunger 7 is thereby opened. The clamps 1, 3 are thus in an open state as shown in FIG. 5, and a bag 5 can be received therein between. The release element 34 is configured such that upon further movement of the respective carrier rail 30*a* in the direction of transportation the release lever 27, 28 is lowered by the force of spring 7. The clamp 1, 3 is thereby closed, as shown in FIG. 5. The bag 5 is thus clamped, resulting in a state as shown in FIG. 2. A plurality of sheet bags 5 which are held in this manner are positioned in the respective receiving elements 2 in one row and are treated at the same time. This can be seen in the top view in FIG. 6. The figure shows two bags, but in practice it is also possible without any difficulties to treat more bags side by side.

As outlined in FIG. 1, after the transfer device 11 the sheet bags are transported in suspended fashion to the opening station 8. FIG. 6 shows this movement in a top view. The guide rolls 23 run in guide links 31, 32 which reduce their distance. The clamps 1 and 3 of each receiving element which are connected to the carriers 21 and 22, respectively, are pushed together in this way. The distance between the respective clamps 1, 3 of a receiving element 2 is reduced by the value 2dB. The sides of the sheet bags diverge, thereby producing an opening 5*a*, as shown in FIG. 3*a*.

In the treatment station 8, a small blow tube is introduced into this resulting opening in a manner which is not shown, the tube blowing air under high pressure into the sheet bag, thereby inflating the sheet bag to create room for the filling material to be introduced.

As shown in FIG. 1, the sheet bags are further conveyed in the opened and inflated state to the filling station 9. The filling material is there filled into the sheet bag by a filling tube means (not shown). The bags which are filled in this manner are further conveyed to the closing station 10. On their way to the closing station, the guide links 31, 32 are again moved apart by the distance 2dB, thereby moving the carriers 21, 22 in opposite directions. The clamps 1, 3 of the respective receiving elements 2 are thereby moved apart from one another, and the upper edge 6 of the sheet bag 5 is tensed and closed. This state is illustrated in FIG. 3*b*. In station 10, the upper edges of the filled sheet bag are sealed to each other and thereby closed by a sealing device which is not shown, but known per se.

The sheet bags closed in this manner are further conveyed into a discharge station 12. In the discharge station 12, the release levers 27, 28 run again on release elements 34 which effect a lifting of the release levers 27, 28, as shown in FIG. 5 and as already described above in connection with the bag receiving operation. The clamps 1, 2 are opened, thereby releasing the sheet bag 5. This bag can, e.g., fall into a receiving container positioned thereunder or can be received by a further station.

In contrast to the above-described embodiment, there may also be provided guide links which lead to a multi-stepped enlargement of the bag opening 5*a*. In the opening station 8, it can e.g. be advantageous when the opening 5*a* is first kept small so that the blown-in air cannot immediately escape again, but is effectively used for enlarging the bag volume. By contrast, the opening 5*a* should be as large as possible underneath the filling station 9, so that the filling material can easily be introduced into the sheet bags.

Hence, the above-described filling machine allows a very easy handling of the individual bags in an in-line indexing machine which subjects the sheet bags in indexed fashion to different treatments. The sheet bags are not transported in an upright manner, but in suspended form in pairs of clamps. Sheet materials that are not very stiff can thus be used because no special stability is required. In the filled state, the sheet bags are nevertheless sufficiently stable. Since the sheet bags are transported in suspended fashion, their size is of no relevance to the operative sequence. Opening the sheet bags by a simple relative movement of the holding clamps relative to one another constitutes a very simple solution for this mechanism which is complicated in known devices having upright bags.

What is claimed is:

1. A filling machine for flexible bags, comprising in combination a plurality of receiving elements with the aid of which the bags are transported at least through an opening station, a filling station and a closing station, wherein each said receiving element comprises at least two holding devices for holding a bag in the upper area thereof in suspended fashion, said holding devices being arranged to be movable relative to one another, each of said holding devices comprising clamp elements for clamping the bags in place, each clamp element comprising a clamp block and a clamp jaw, said clamp jaws which is movable relative to said block having formed thereon pressing means upon the actuation of which said clams jaw is moved away from the respective clamp block, said pressing means being provided with a respective actuator including a spring, said actuator upon actuation against the force of said spring removes the clamp jaw from the clamp block, and said actuator being respectively passed through the clamp block of the respective holding device and being fixedly connected to the clamp jaw.

2. The filling machine according to claim 1, and at least one first and at least one second elongated carrier, said carriers extending in parallel with each other and being movable relative to each other, and the respectively first said holding device of said receiving element being secured to said first carrier and the respectively second said holding device being secured to said second carrier.

3. The filling machine according to claim 9, wherein said carriers are movable relative to each other in their longitudinal direction.

4. The filling machine according to claim 2 or 3, wherein said first and second carriers comprise guide rolls which during movement of said receiving elements along said treatment stations run along a respective guide link and thereby move said carriers relative to one another.

5. The filling machine according to claim 2 or 3, wherein said first and second carriers comprise guide roll members which during movement of said receiving elements along said treatment stations run in a respective guide link and thereby move said carriers relative to one another.

6. The filling machine according to claim 1 wherein first and second release means, which during movement of the receiving elements along those stations of the filling machine on which the bags are received or discharged, interact with stationary release elements such a manner that a movement of said first and second release means initiated by the interaction leads to a movement of said actuator against the force of said respective spring.

7. The filling machine according to claim 6, wherein said first and second release means comprise rods which are arranged in parallel to said first and second carriers.

8. The filling machine according to claim 2 and wherein a plurality of receiving elements are arranged in one row in a direction perpendicular to the direction of movement so that they pass through said treatment stations at the same time and in synchronism.

9. The filling machine according to claim 8, wherein a said first carrier and second carrier are provided per row of said receiving elements.

10. A filling machine for flexible bags comprising a plurality of receiving elements with the aid of which the bags are transported at least through an opening station, a filling station, and a closing station, wherein each receiving element comprises at least two holding devices for holding a bag in the upper area thereof in suspended fashion, the holding devices being arranged to be moveable relative to one another and comprise clamp elements for clamping the bags in place, the clamp elements comprising a clamp block and a clamp jaw being movable relative to said block, at least one first and at least one second elongated carrier, said carriers extending in parallel with each other and being movable relative to each other, and the respectively first holding device of a receiving element being secured to the first carrier and the respectively second holding device being secured to the second carrier, the clamp jaws having formed thereon a pressing means which is provided with a respective actuator including a spring, said respective actuator upon actuation against the force of the spring moves the clamp jaw away from the clamp block, and wherein first and second release means are provided which during movement of the receiving elements along those stations of the filling machine on which the bags are received or discharged, interact with stationary release elements in such a manner that the movement of the first and second release means initiated by the interaction leads to a movement of the actuator against the force of the respective spring, and said first and second release means comprise rods which are arranged in parallel to said first and second carriers.

11. The filling machine according to claim 10 and wherein a plurality of receiving elements are arranged in one row in a direction perpendicular to the direction of movement so that they pass through said treatment stations at the same time and in synchronism.

12. The filling machine according to claim 11, wherein one of said first carriers and one of said second carriers are provided per row of receiving elements.

13. A filling machine for flexible bags comprising receiving elements with the aid of which the bags are transported at least through an opening station, a filling station, and a closing station, wherein each receiving element comprises at least two holding devices for holding a bag in the upper area thereof in suspended fashion, the holding devices comprising clamp elements for clamping the bags in place and being arranged to be moveable relative to one another, each of the clamp elements comprising a clamp block and a clamp jaw which is moveable relative to said clamp block, the clamp jaws having formed thereon a pressing means upon the actuation of which a clamping jaw is removed from the respective clamping block, said pressing means being provided with a respective actuator including a spring, said actuator upon actuation against the force of the spring removes the clamp jaw from the clamp block, the actuator being respectively passed through the clamp block of the respective holding device and being fixedly connected to the clamp jaw; and a plurality of said receiving elements are arranged in one row in a direction perpendicular to the direction of movement of the receiving elements so that they pass through the treatment stations at the same time and in synchronism, wherein a first and second elongated carrier are provided per row of receiving elements, said carriers extending in parallel with each other and being movable relative to each other in their longitudinal direction, and the respectively first holding device of one of said receiving elements being secured to the first carrier and the respectively second holding device being secured to the second carrier, the receiving elements being mounted in an easily removable manner.

14. The filling machine according to claim 13, wherein the moveable carrier comprises a guide roll which during movement of the receiving elements along the treatment stations runs along a guide link so that the moveable carrier is displaced.

15. The filling machine according to claim 13, wherein the moveable carrier comprises a guide roll which during movement of the receiving elements along the treatment stations runs in a guide link so that the moveable carrier is displaced.

16. The filling machine according to claim 13, wherein first and second carriers have provided thereon guide rolls which upon movement of the receiving elements along the treatment stations run in a respective guide link, and thereby move the carriers relative to one another.

17. The filling machine according to claim 13, wherein first and second carriers have provided thereon guide rolls which upon movement of the receiving elements along the treatment stations run on a respective guide link, and thereby move the carriers relative to one another.

18. The filling machine according to claim 13, wherein first and second release means which during movement of the receiving elements along those stations of the filling machine on which the bags are received or discharged, interact with stationary release elements in such a manner that the movement of the first and second release means initiated by the interaction leads to a movement of the actuator against the force of the respective spring.

19. The filling machine according to claim 18, wherein the first and second release means comprise rods which are arranged in parallel to the first and second carriers.

* * * * *

UNITED STATES PATENT AND TRADEMARK OFFICE

CERTIFICATE OF CORRECTION

PATENT NO. : 6,073,424
DATED : June 13, 2000
INVENTOR(S) : Eberhard Kraft, Hans-Peter Wild It is certified that error appears in the above-identified patent and that said Letters Patent is hereby corrected as shown below:

Claim 1,
Line 11, after "clamp jaw", delete ", said clamp jaws";
Line 12, before "block", insert -- clamp -- and after "block", insert --, said clamp jaws --; and
Line 13, delete "clams" and substitute -- clamp --.

Claim 3,
Line 1, "claim 9" should read -- claim 2 --.

Claim 10,
Line 25, after "which", insert -- , --.

Signed and Sealed this

Twenty-Seventh of November, 2001

*Attest:*

Nicholas P. Godici

*Attesting Officer*

NICHOLAS P. GODICI
*Acting Director of the United States Patent and Trademark Office*